US007658229B2

(12) United States Patent
Becker et al.

(10) Patent No.: US 7,658,229 B2
(45) Date of Patent: Feb. 9, 2010

(54) GAS LIFT CHAMBER PURGE AND VENT VALVE AND PUMP SYSTEMS

(75) Inventors: Billy G. Becker, Ventura, CA (US); David A. Tucker, Camarillo, CA (US)

(73) Assignee: BST Lift Systems, LLC, Ventura, CA (US)

( * ) Notice: Subject to any disclaimer, the term of this patent is extended or adjusted under 35 U.S.C. 154(b) by 244 days.

(21) Appl. No.: 11/278,249

(22) Filed: Mar. 31, 2006

(65) Prior Publication Data

US 2007/0235197 A1 Oct. 11, 2007

(51) Int. Cl.
*E21B 34/10* (2006.01)
*F04F 1/08* (2006.01)
*F04F 1/20* (2006.01)

(52) U.S. Cl. ..... 166/372; 166/375; 166/322; 417/115; 417/54; 137/155

(58) Field of Classification Search ..... 166/319, 166/370, 372, 374, 375, 322; 417/112–115, 417/54; 137/155
See application file for complete search history.

(56) References Cited

U.S. PATENT DOCUMENTS 3,225,783 A * 12/1965 Stacha ..... 137/155
3,617,152 A * 11/1971 Cummings ..... 417/14
4,791,990 A * 12/1988 Amani ..... 166/311
5,066,198 A * 11/1991 Decker ..... 417/54
5,458,200 A * 10/1995 Lagerlef et al. ..... 166/372
5,782,261 A 7/1998 Becker et al.
5,806,598 A * 9/1998 Amani ..... 166/372
6,904,893 B2 6/2005 Hotta et al.
6,973,973 B2 12/2005 Howard et al.

OTHER PUBLICATIONS

International Search Report, dated Oct. 22, 2007, for application No. PCT/US 07/64701.
Written Opinion of the International Searching Authority, dated Oct. 22, 2007, for application No. PCT/US 07/64701.

* cited by examiner

*Primary Examiner*—Kenneth Thompson
(74) *Attorney, Agent, or Firm*—Locke Lord Bissell & Liddell, LLP

(57) ABSTRACT

The present invention is directed to producing fluid from an oil or gas well by means of a combination intermittently filled down hole chamber accumulation device and a connected upper continuous gas lift flow system, separated by an inline one-way reverse flow check valve. A two-way purge and vent valve controls the distribution of high pressure gas. The two-way valve first injects high pressure gas into the chamber accumulation device to displace the fluid from the chamber into the continuous flow conduit. The two-way valve then vents the residual high pressure gas from the chamber into a separate low pressure conduit to the surface. The valve also provides high pressure gas to the continuous flow conduit to assist in the production of the fluid.

7 Claims, 14 Drawing Sheets

GAS LIFT CHAMBER PURGE AND VENT VALVE AND PUMP SYSTEMS

BACKGROUND OF THE INVENTION

1. Field of the Invention

This invention relates to gas lift systems for the production of fluid from oil, gas, or water wells and, more particularly, to a gas lift system for the production of fluid from oil, gas, or water wells using a gas displacement chamber.

2. Description of Related Art

The present invention is directed to well tools for oil and gas wells for lifting fluids from oil and gas wells. High pressure injection gas has been used to produce well fluids from oil and gas wells for many years utilizing either continuous flowing or intermittent flowing gas lift systems. Both gas lift systems are well known to the petroleum industry. Chamber gas lift, with or without a single reverse flow check valve in the bottom, has also been used in various forms, for intermittent gas lift production and for providing a deeper lift point of injection in both intermittent gas lift or continuous gas lift wells with long producing zones and/or multiple zones. Other previous chamber lift systems utilizing two-stage chamber lift produced fluid in two intermittent phases or slugs, first from the lower chamber into the production conduit above an upper reverse flow check, and then producing the slug of fluid to the surface intermittently have been used. The lower chamber could be vented into a low pressure conduit between the next simultaneous lift cycle. Early examples were "Camp Pump" (George Camp) and the Teledyne Merla "ACV" Automatic Chamber Vent devices in the 1970-1980's.

The use of wire line retrievable gas lift valves in side pocket gas lift mandrels has been well known in the industry for many years. Coiled tubing service rigs can now perform most of the same operations. The use of side pocket mandrels in chamber gas lift wells has also been common for many years; however, such mandrels and corresponding valves have been limited to two pocket seal areas, separate from the latch profile and any latch debris seal area. Prior art includes an earlier pilot valve with two pocket seals which did provide a method of injecting lift gas into the chamber and then venting residual lift gas from the chamber back into the fluid production conduit after the fluid slug had cleared the tubing at the surface and pressure decreased between injection cycles. The valve had a very small and complicated vent passageway which traveled through the valve main and pilot sections and discharged above the upper pocket seal and back into the interior area of the mandrel.

Three-seal pocket wire line retrievable valve mechanisms have been used in subsurface safety valve systems for oil and gas wells; however, these valves and mandrels have been limited to a single passageway for shutting off a flow conduit in case of emergencies. The area between upper two seal areas provides only an inlet for an actuating signal from a separate surface conduit to the valve controlling a single flow passageway.

SUMMARY

The present invention is directed to a device and method for producing fluid from an oil or gas well by means of a combination intermittently filled down hole chamber accumulation device and a connected upper continuous gas lift flow system, separated by an inline one-way reverse flow check valve. The chamber accumulation device comprises reverse flow check valves in the bottom intake section and in the top portion of the chamber device. A two-way purge and vent valve controls the distribution of high pressure gas. The two-way valve first injects high pressure gas into the chamber accumulation device to displace the fluid from the chamber into the continuous flow conduit. The two-way valve then vents the residual high pressure gas from the chamber into a separate low pressure vent conduit to the surface. The valve also provides high pressure gas to the continuous flow conduit to assist in the production of the fluid. The low pressure conduit may also connect to the well bore inflow area where well gas which separates from the fluid inflow in the well bore can flow to the surface independent of both the chamber and the continuous flow conduit.

In a preferred embodiment, three-seal areas on the exterior of the valve body when aligned with three internal polished bore sections of the mandrel pocket form two separate pressure containing annulus areas between the pocket interior and the valve exterior. High pressure gas is ported into the area bounded by the top two seals of the mandrel pocket from either the mandrel body exterior or from the mandrel internal flow area. The valve pilot section and main port section have inlet ports open to this upper pressure containing area. When gas pressure reaches a predetermined level the pilot section of the valve actuates the main port section open and high pressure gas is injected through an opened interior passageway and through the ported bottom cap, similar to the operation of a standard pilot operated gas lift valve.

However, the main port section of the preferred embodiment has a passageway from the area between the lower two pocket seals through the ported bottom cap, which is closed when the pilot valve section actuates open for injection and is opened when the pilot valve section actuates closed. This allows vent gas from the chamber to enter the valve through the bottom cap and exit through a port between the lower two pocket seal and into a vent conduit.

The gas lift system can be either wire line/coiled tubing serviceable or serviceable by a conventional pulling rig. In the non-wire line/coiled tubing serviceable configuration, the equipment can be run as concentric coiled tubing or jointed tubing or a combination of both jointed tubing and coiled tubing. In the wire line/coiled tubing serviceable version, a wire line retrievable venting pilot gas lift valve and corresponding side pocket mandrel with three pocket seals areas below the latch can be run with jointed tubing, coiled tubing, or with a combination of jointed and continuous coiled tubing. The system can be configured for installation and removal from the well by conventional or coiled tubing completion rigs. The system can be configured to be run with concentric coiled tubing or it can be configured to be run as jointed tubing or with combinations of both and with or without wire line/coiled tubing serviceable valve mechanisms.

The disclosed method consists of producing fluid from a well bore with a multiplicity of small intermitting volumes using a lower chamber device to feed into and maintain a secondary continuous flow stream in an upper flow conduit connected through a reverse flow valve. This method allows for the chamber to operate independently from the upper lift system. The upper lift system has an independent injection source from but is dependent on the volume and frequency of the fluid inflow slugs from the lower chamber.

BRIEF DESCRIPTION OF THE DRAWINGS

The apparatus of the invention is further described and explained in relation to the following figures wherein.

DESCRIPTION OF THE PREFERRED EMBODIMENT

Figure 1:
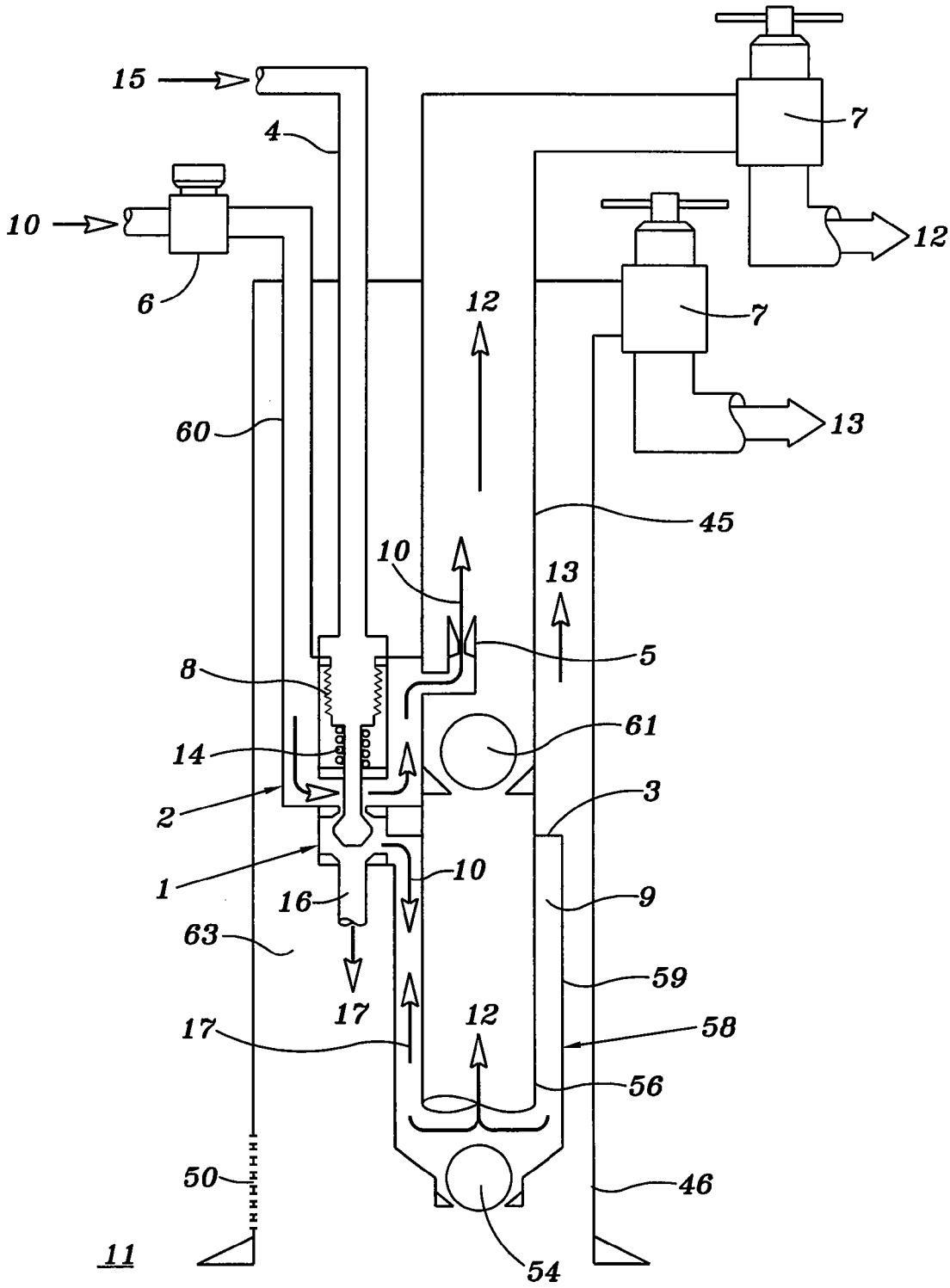
FIG. 1 is a schematic view of a well utilizing a preferred tubing retrievable embodiment of the two-way purge and vent valve of the present invention referred to as a parallel two stage gas pump.

Disclosed herein is a system and method of producing fluid from an oil well or gas well or water well by rapidly displacing small volumes of accumulated fluid from a well bore into a connected flow conduit using a high pressure gas displacement chamber device. In the flow conduit, the fluid is produced in a sustained continuous gas lift flow column to the surface. The wells are usually cased holes which connect surface production handling facilities with an oil, water, or gas producing formation.

The preferred system of the disclosed method consists of a tubular conduit connected at the surface and extending down to the top section of a chamber accumulation device at or near the depth of the producing zone of the well. This chamber accumulation device preferably consists of two tubular members, either concentric or parallel to each other, which are connected at the top and bottom creating a device similar to a U-tube with reverse flow check valves in the bottom intake section of the U-tube chamber and the other in the top portion of the chamber device. A separate conduit connects and supplies high pressure injection gas to a two-way valve mechanism in the top portion of the chamber device and also to a control mechanism to supply high pressure gas for injection in the upper flow conduit to maintain the continuous lift flow to the surface.

A two-way valve mechanism first injects high pressure gas into the top of the chamber side of the U-tube to displace the fluid from the chamber into the continuous fluid flow production conduit side of the U-tube connected above the top reverse flow check valve. The two-way valve then vents the residual high pressure gas from the chamber device into a separate low pressure conduit to the surface. The two-way valve also preferably continuously adds high pressure gas to the continuous fluid flow production conduit to provide a lift gas. The vent conduit also preferably connects to the well bore inflow area where well gas which separates from the fluid inflow in the well bore can flow to the surface independent of both the chamber and the continuous flow conduit.

The cycle frequency of the two-way chamber valve is controlled by the either the pressure of the injection gas pressure or by a separate pressure signal via a separate conduit to the surface. The chamber device cycle frequency is adjusted to match the well formation's ability to produce into the well bore. This method of artificial lift isolates the producing well bore from any residual flowing back pressure resulting from the continuous flow gas lift production process or the fall back of an intermittent gas lift process, resulting in greater and more efficient production than is possible by previous intermittent or continuous flow gas lift systems.

The overall preferred apparatus, including the multiple flow conduits for the produced fluid, vented gas, high pressure injection gas and/or chamber cycle control pressure signals, is installed in the well using jointed tubular components, continuous reel tubular components, or a combination of both. The apparatus is installed into or can be pulled from the well by a work-over or completion or coiled tubing rig and is configured such that some or all of the valve mechanisms including the two-way chamber vent and purge valve, the two reverse flow checks, and the valve/orifice mechanism which inject gas in the continuous flow section, can be pulled for servicing and rerun into the well by either wire line or coiled tubing service operations.

In a conventional rig serviceable configuration using the preferred embodiment, a pressure controlled timing device at the surface sends a pressure signal through a conduit connecting to a two-way valve mechanism in the bottom hole chamber device. Pressure on the signal conduit activates the two-way valve opening a passageway from the high pressure injection gas conduit through the two-way valve mechanism and into the chamber device while closing off a passageway from the chamber device and a venting conduit. The high pressure injection gas then displaces fluid accumulated from the well bore above the lower reverse check valve forcing the fluid into the upper continuous flow column above the upper reverse check valve.

Release of the pressure signal at the surface returns the two-way valve in the chamber device back to its non-pressured position thus closing the high pressure injection passageway to the chamber device and re-opening the passageway from the chamber device to the vent conduit, thereby allowing residual gas in the chamber device to be vented. As the chamber device is vented, well bore fluid is allowed to refill the chamber device. A separate valve or orifice mechanism also connected to the high pressure injection gas injects gas into the upper continuous flow stream above the upper reverse check valve to aerate the produced fluid from the chamber device displacements to maintain the continuous lift gas column. The apparatus can be installed into the well as a single three-conduit concentric coiled tubing installation or as a combination jointed tubing and coil tubing combination.

In a preferred wire line or coiled tubing serviceable component configuration embodiment, the method of artificial lift is similar except that some or all of the valve mechanisms in the down hole portions are designed to be serviceable by wire line or coiled tubing servicing operations common to the industry. The preferred apparatus incorporates a purge and vent pilot operated gas lift valve designed for installation into a three-seal gas lift side pocket mandrel, and methods to incorporate both into a gas pump chamber lift assembly for utilizing high pressure gas to produce oil and gas wells are disclosed.

Described is a preferred gas lift pilot valve mechanism, which is comprised of a pressure operated upper pilot section and a lower bi-directional main valve section. When actuated to the open position by the pilot section, the main valve section travels such that it provides an open passageway from an injection port located between the upper pocket seal and middle pocket seal and through the ported bottom cap, while simultaneously blocking a separate passageway from a vent port located between the lower pocket seal and the middle pocket seal and through the ported bottom cap. And when actuated to the opposite closed position by the pilot section, the main valve section simultaneously blocks the injection passageway and opens the vent passageway. The preferred three-seal purge and vent valve of this invention, when attached to a separate latch mechanism, with or without an integral latch debris seal, can be installed into or removed from the three-seal side pocket mandrel of this invention by wire line methods common to the industry.

A preferred embodiment of the present invention in the vent position provides a direct and unrestricted vent passageway from the ported bottom cap to a discharge port between the lower and middle pocket seals unobstructed by either the main valve or pilot valve sections, thus being a less complicated and more reliable improvement over prior valves that have a very small and complicated vent passageway through the valve. Additionally, the vented gas can be either discharged through a port connecting to the interior flow area of the mandrel or to a port connecting the mandrel pocket to a separate low pressure venting conduit providing great flexibility for use in the present invention or for use in existing chamber design options.

The preferred embodiment of the present invention combines both injection and vent functions into a single valve, thus simplifying earlier chamber lift designs, troubleshooting, and wire line/coil tubing maintenance techniques. The increased non-obstructed venting capabilities of the preferred embodiment, either into a separate venting conduit or back into the fluid production conduit above the chamber, result in quicker and more complete residual gas venting and increased well production. In connection with the following description of various embodiments, the same reference numerals have been used to depict similar structure.

Figure 2:
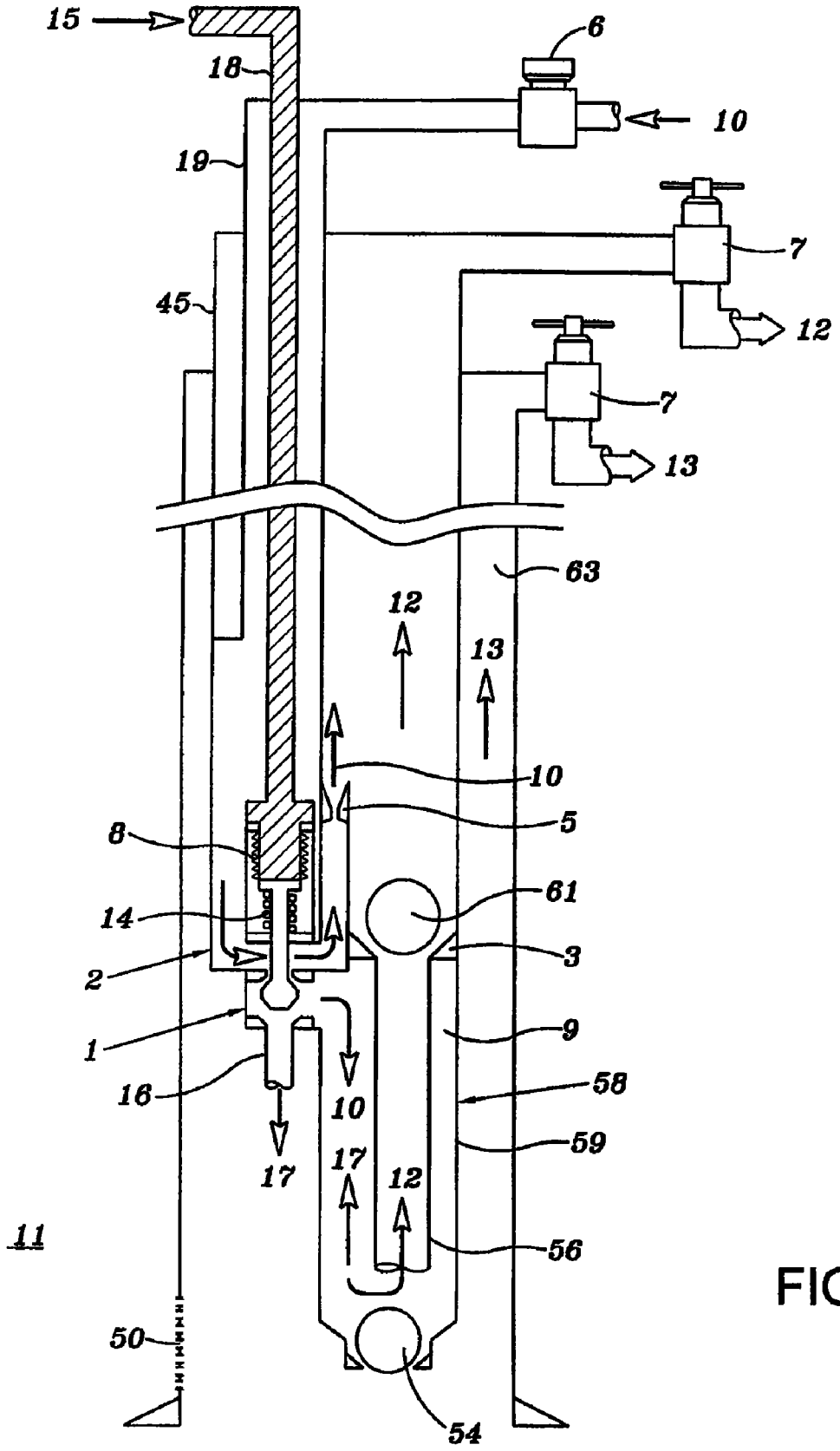
FIG. 2 is a schematic view of a well utilizing a preferred coiled tubing deployed embodiment of the two-way purge and vent valve of the present invention having the hanger configuration and referred to as a coiled tubing two stage gas pump.
Figure 3:
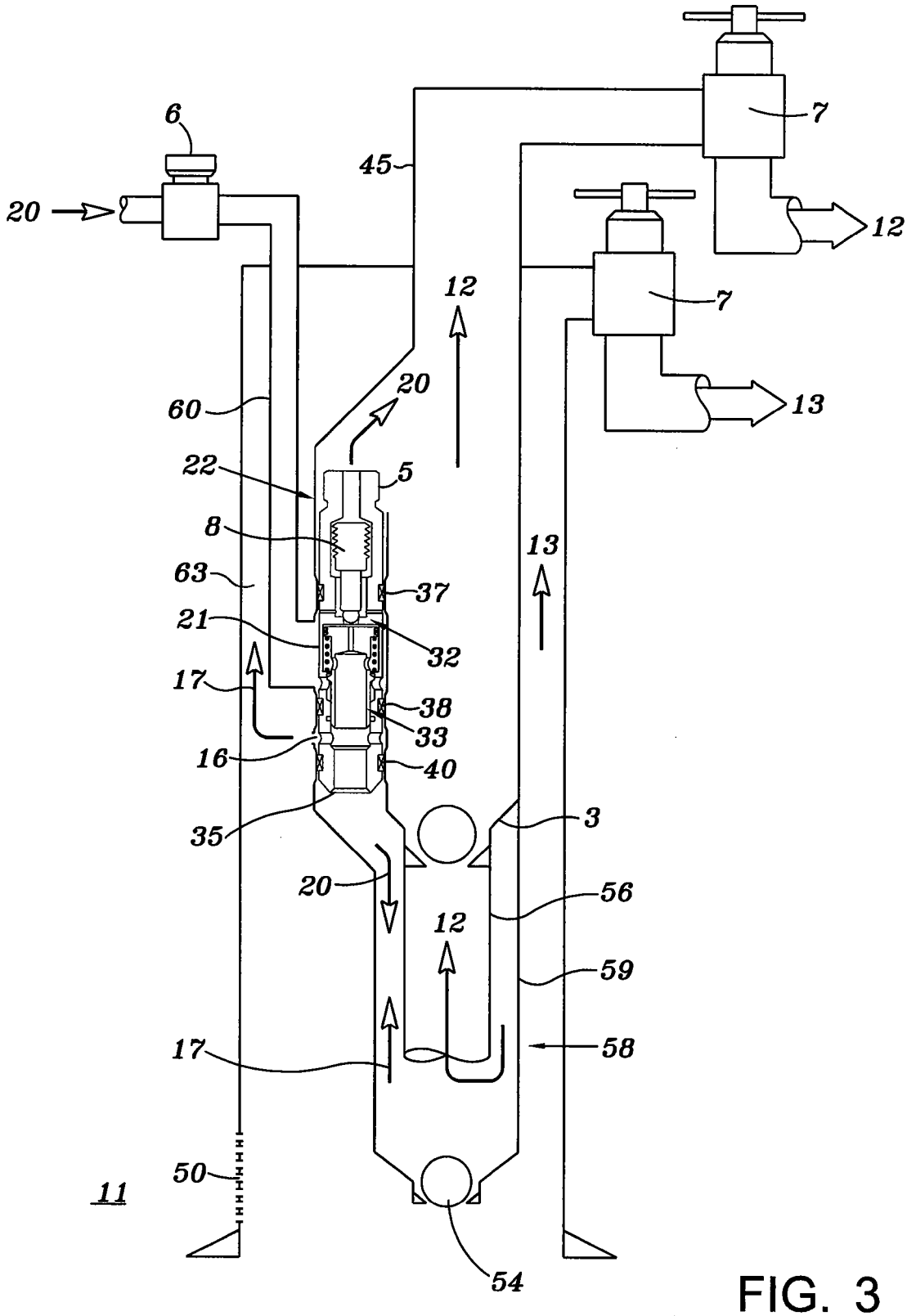
FIG. 3 is a schematic view of a well utilizing a preferred wire line retrievable three seal two-way purge and vent valve and side pocket mandrel embodiment of the present invention referred to as a wireline retrievable two stage gas pump.

FIGS. 1, 2, and 3 illustrate various well schematics in which various preferred embodiments of the current invention are used and where the purge and vent valve is installed above the well inflow perforations 50 of the casing.

FIG. 1 illustrates a cross sectional well schematic of a preferred parallel two stage gas pump embodiment of the present invention. This embodiment utilizes a tubing retrievable two-way purge and vent valve 1 of the present invention in a tubing retrievable mandrel 2 having a hanger configuration 3, a first external side string conduit 4 providing a gas or fluid pressure signal 15 to the tubing retrievable two-way purge and vent valve 1, a continuous flow orifice valve 5, an upper check valve 61, and an intermittent chamber 58. The intermittent chamber 58 comprises a dip tube 56, chamber shell 59, and lower check valve 54.

The entire gas lift system, including the intermittent chamber 58, the two-way valve 1, along with associated strings, including side string 4, side string 60, and producing tubing 45 is installed into the well at or near the producing formation 11, preferably inside well casing 46. Typically well casing 46 contains well inflow perforations 50 near its bottom to allow the well fluids 12 to pass through well casing 46 from formation 11. Well fluids 12 passes through lower check valve 54 in intermittent chamber 58 and enters dip tube 56 and the annulus 9 between dip tube 56 and chamber shell 59. Once well fluids 12 enters intermittent chamber 58, check valve 54 prevents well fluids 12 from exiting intermittent chamber 58 back into well casing annulus 63 or formation 11.

Injection gas 10 is supplied to the two-way purge and vent valve 1 and to a continuous lift orifice valve 5 by means of a second external side string 60. The flow and pressure of injection gas 10 is controlled by an adjustable injection flow control choke 6. Similarly, the flow and pressure of produced fluid 12 is controlled by an adjustable production flow control choke 7. The flow and pressure of produced and vented gas 13 is controlled by an adjustable production flow control choke 7.

A gas or fluid pressure signal 15 is sent through the first external side string 4 to operate a bellows 8 in valve 1. This signal 15 is sent by increasing the pressure of a gas or other fluid, sometimes referred to as 'motive gas', in side string 4. The increased pressure of pressure signal 15 acts upon the bellows 8 to move the two-way purge and vent valve 1 to the purge mode. When the pressure signal 15 is released by reducing the pressure in side string 4, a return spring 14 returns the two-way purge and vent valve 1 to the vent mode.

Injection gas 10 is injected through the second external side string 60. Injection gas 10 is directed both to the continuous flow orifice valve 5 and through the two-way purge and vent valve 1. When the two-way purge and vent valve 1 is in the purge mode, the injection gas 10 is directed to the annulus 9 between the shell 59 and dip tube 56 of the intermittent chamber 58. Injection gas 10 directed to the annulus 9 between the shell 59 and dip tube 56 of the intermittent chamber 58 displaces well fluids 12 in the annular space 9 and dip tube 56. Because check valve 54 prevents well fluids 12 from exiting the chamber 58, the well fluids 12 are forced through the upper check valve 61 and into production tubing 45. Check valve 61 prevents well fluids 12 from entering back into intermittent chamber 58 from producing tubing 45. Well fluids 12 above the upper check valve 61 are then continuously produced up the production tubing 45 by injection gas 10 provided through the continuous flow orifice valve 5, and to the surface through production flow control choke 7.

When the two-way purge and vent valve 1 is in its vent mode, injection gas 10 is prevented from entering the annulus 9 between the shell 59 and dip tube 56 of the intermittent chamber 58. Instead, the two-way purge and vent valve 1 opens a passageway 16 for vent gas 17 to vent from the annulus 9 between the shell 59 and dip tube 56 of the intermittent chamber 58 into the casing annulus 63. Vent gas 17 is generally composed of injection gas 10 that was previously injected into intermittent chamber 58 when two-way valve 1 was in the purge position. Vent gas 17 joins with naturally produced gas from the well producing formation 11 and travels up the casing annulus 63 to the surface as produced and vented gas 13 and exits through production flow control choke 7. Additional well fluids 12 are pulled from well casing annulus 63 and formation 11 into chamber 58 to replace the vent gas that exited out passageway 16.

By cycling the gas or fluid pressure signal 15, the two-way purge and vent valve 1 goes through purge and vent cycles. During each cycle an amount of well fluids 12 is moved into chamber 58 and then up into producing tubing 45. Well fluids 12 in producing tubing 45 are continuously produced to the surface. The gas or fluid pressure signal 15 is preferably cycled at a rate based upon the ability of formation 11 to produce well fluids 12 into chamber 58.

FIG. 2 illustrates a cross-sectional well schematic of a preferred coiled tubing two stage gas pump embodiment of the present invention. A tubing retrievable two-way purge and vent valve 1 is used in a tubing retrievable mandrel 2 having a hanger configuration 3. A first concentric internal coiled tubing conduit 18 provides motive gas or fluid to generate a gas or fluid pressure signal 15 to the tubing retrievable two-way purge and vent valve 1. Two-way purge and vent valve 1 further contains a continuous flow orifice valve 5. Chamber 58 is composed of an upper check valve 61, a dip tube 56, chamber shell 59, and lower check valve 54.

Injection gas 10 is supplied to the two-way purge and vent valve 1 of this invention and to a continuous lift orifice valve 5 by means of a second concentric coiled tubing conduit 19 internal to the production tubing 45 and external to the motive gas or fluid conduit 18. The flow and pressure of injection gas 12 is controlled by an adjustable injection flow control choke 6, while the flow and pressure of well fluid 12 is controlled by an adjustable production flow control choke 7, and the flow and pressure of produced and vented gas 13 is controlled by an adjustable production flow control choke 7. A gas or fluid pressure signal 15 is sent through the first concentric internal coiled tubing conduit 18 to operate bellows 8, which moves the two-way purge and vent valve 1 to the purge mode. When the pressure signal 15 is released, a return spring 14 returns the two-way purge and vent valve 1 to the vent mode.

When the two-way purge and vent valve 1 is in the purge position, injection gas 10 from the first concentric internal coiled tubing conduit 18 is directed both to the continuous flow orifice valve 5 and to the annulus 9 between the shell 59 and dip tube 56 of the intermittent chamber 58. Injection gas 10 directed to the annulus 9 between the shell 59 and dip tube 56 of the intermittent chamber 58 displaces well fluids 12 in that annular space 9 and into the dip tube 56 and from thence past the upper check valve 61. Produced well fluids 12 above the upper check valve 61 are then continuously produced up the production tubing 45 to the surface. Injection gas 10 provided to the production tubing 45 through continuous flow orifice valve 5 acts as a lift gas to assist in the production of well fluids 12.

When the two-way purge and vent valve 1 is in its vent mode, injection gas 10 is prevented from entering the annulus 9 between the shell 59 and dip tube 56 of the intermittent chamber 58. Instead the two-way purge and vent valve 1 opens a passageway 16 for vent gas 17 to vent from the annulus 9 between the shell 59 and dip tube 56 of the intermittent chamber 58 into the casing annulus 63. Vent gas 17 is generally composed of injection gas 10 that was injected into chamber 58 during the purge phase. Vent gas 17 joins with naturally produced gas from the well producing formation 11 and travels up the casing annulus 63 to the surface as produced and vented gas 13.

FIG. 3 illustrates a cross-sectional well schematic of a preferred wire line retrievable three seal two stage gas pump embodiment of the present invention. A wire line retrievable two-way purge and vent valve 21 of the present invention is utilized in a three seal sidepocket gas lift mandrel 22 having a hanger configuration 3. An external side string conduit 60 provides high pressure injection gas 20 to the wireline retrievable two-way purge and vent valve 21 and continuous flow orifice valve 5. The intermittent chamber 58 is composed of an upper check valve 61, a dip tube 56, chamber shell 59, and lower check valve 54. The flow and pressure of high pressure injection gas 20 is controlled by an adjustable injection flow control choke 6, while the flow and pressure of produced well fluids 12 is controlled by an adjustable production flow control choke 7, and the flow and pressure of produced and vented gas 13 is controlled by an adjustable production flow control choke 7.

Instead of using a separate gas or fluid pressure signal, this embodiment uses the pressure of high pressure injection gas 20 to operate the two-way purge and vent valve 21. High pressure injection gas 20 sent through the external side string 60 operates the pilot valve section 32 of the two-way purge and vent valve 21, which moves the main valve section 33 of the wireline retrievable two-way purge and vent valve 21 to the purge mode. When the pressure of injection gas 20 is lowered, the two-way purge and vent valve 21 returns to the vent mode.

Two-way purge and vent valve 21 contains three external seals, upper seal 37, middle seal 38, and lower seal 40, that seals the two-way valve in side pocket mandrel 22. External side string conduit 60 is in fluid communication with the two-way valve between the upper seal 37 and the middle seal 38. Passageway 16 is in fluid communication between middle seal 38 and lower seal 40. In its purge position, two-way valve 21 provides fluid communication between external side string conduit 60 and ported bottom cap 35. This allows injection gas 20 to pass through two-way purge and vent valve 21 and enter the annulus 9 between shell 59 and dip tube 56 of the chamber 58.

Injection gas 20 directed to the annulus 9 between the shell 59 and dip tube 56 of the chamber 58 displaces formation well fluids 12 in that annular space 9 and into the dip tube 56 and up past the upper check valve 61. Produced well fluids 12 above the upper check valve 61 are then continuously produced up the production tubing 45 to the surface. Regardless of the position of two-way purge and vent valve 21, injection gas 20 passes through two-way valve 21 to exit continuous orifice 5 and enter production tubing 45. The injection gas 20 exiting continuous orifice 5 acts as a lift gas to assist in the production of well fluids 12 to the surface.

When two-way valve 21 is in vent mode, injection gas 20 is blocked and two-way valve places passageway 16 in fluid communication with bottom cap 35. This allows vent gas 17 to exit chamber 58 and enter casing annulus 63. Vent gas 17 mixes with naturally produced gas from formation 11 to form produced and vented gas 13. Produced and vented gas 13 travels up well casing annulus 63 to the surface and is produced through production flow control choke 7.

Figure 4:
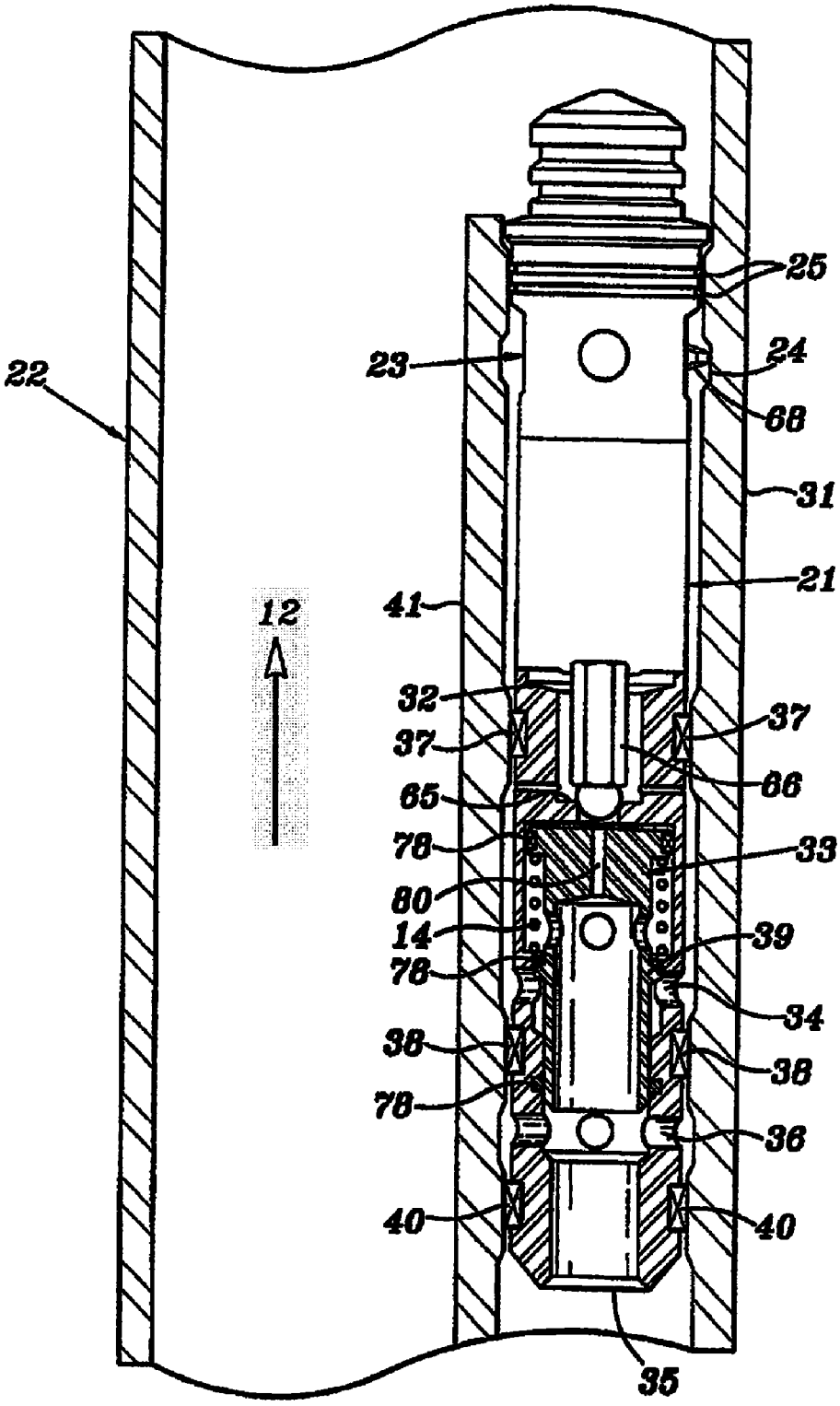
FIG. 4 is a cross-sectional partially cut away view of a preferred three-seal wire line retrievable valve of this invention with its applicable components installed in side pocket gas lift mandrel segment, shown in the closed, venting position, with no radial mandrel porting shown.

FIG. 4 illustrates a cross section view of the pocket section of a preferred three-seal area wire line retrievable purge and vent valve 21 and a three-seal area sidepocket gas lift chamber mandrel 22, formed by an external pocket wall 31 and an internal pocket wall 41. This valve is shown installed into the pocket of the sidepocket mandrel 22 and held in place by a separate latch device 23. A latch finger 68 on the latch device 23 is secured in a locking profile in a pocket 24 located in the upper part of the external pocket wall 31 of side pocket mandrel 22. The latch 23, common to the industry, is shown with optional integral latch seals 25 to seal two-way valve 21 in side pocket mandrel 22. The pilot valve seat 65 and pilot valve stem 66 are shown in the closed position. The main valve section 33 is shown unactuated (i.e. in the vent position) in that valve mechanism 39 is blocking injection port 34 and is not blocking vent port 36 in the two-way valve. Although present, the passageway 16 and radial porting in the valve receiver pocket for the injection gas 20 are not shown in this illustration.

Figure 5:
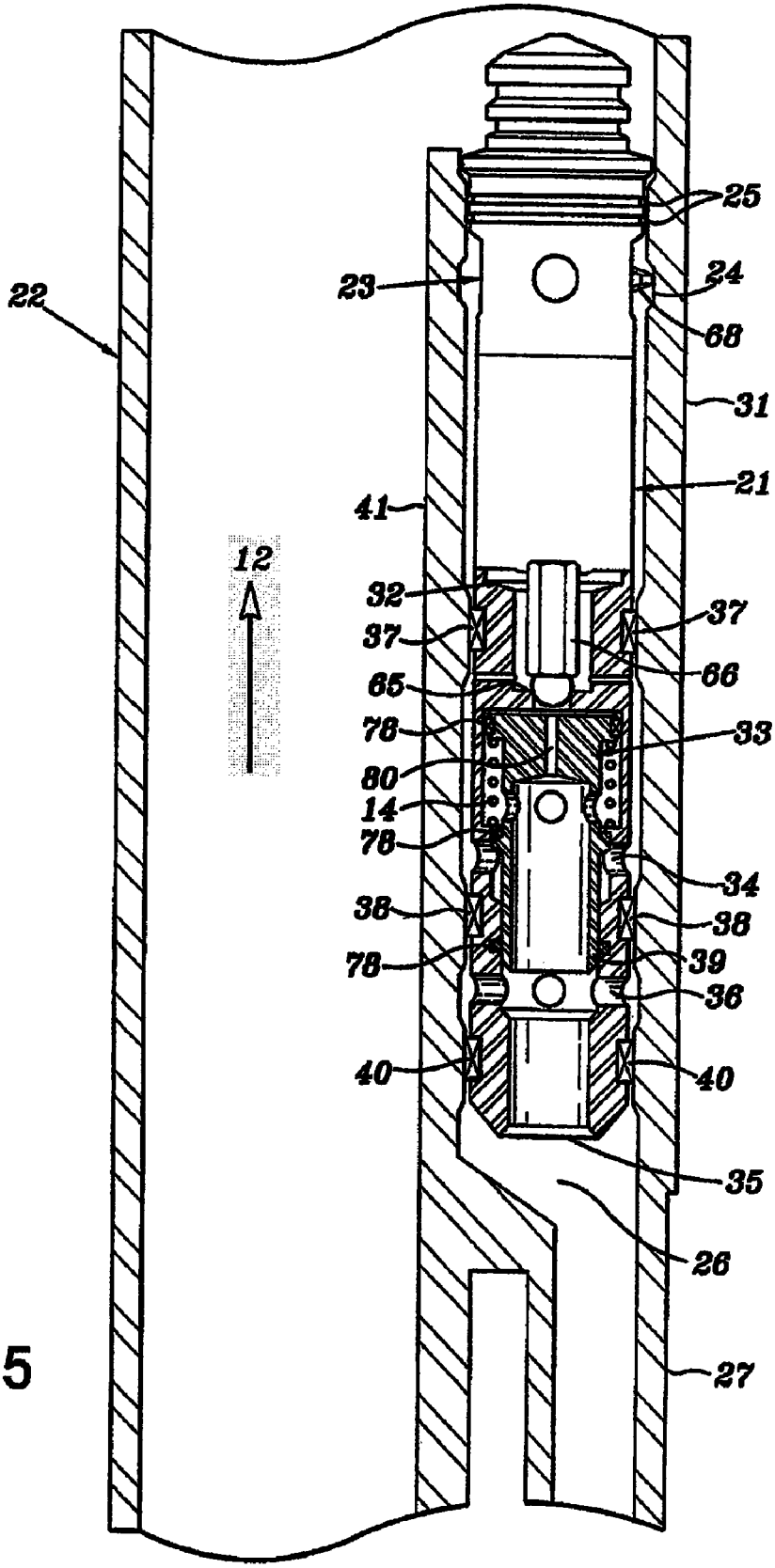
FIG. 5 is a cross-sectional partially cut away view of a preferred three-seal wire line retrievable valve of this invention, with a bottom external discharge configuration, that is installed in a side pocket gas lift mandrel segment shown in the closed, venting position, with no radial mandrel porting shown.
Figure 6:
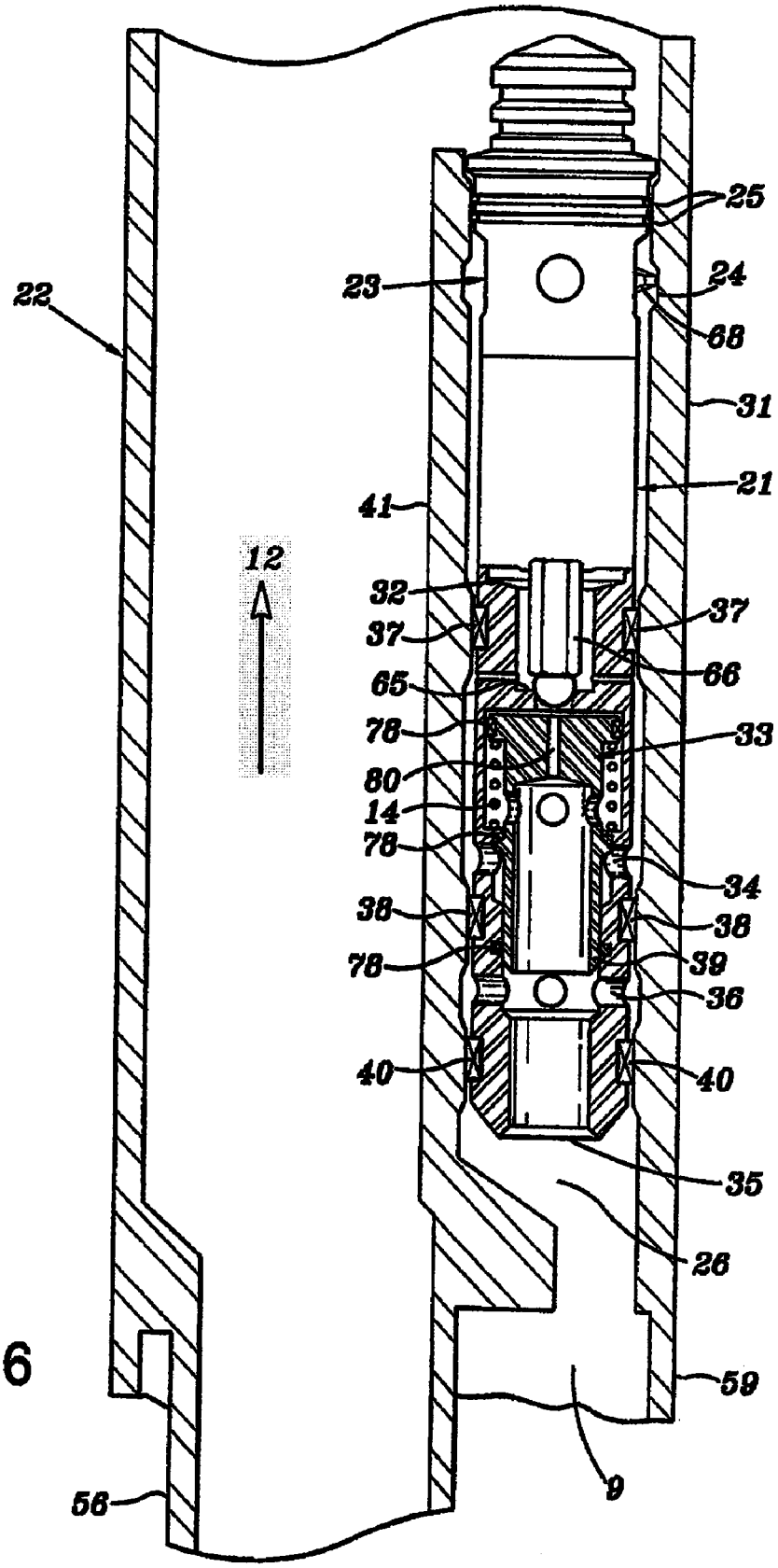
FIG. 6 is a cross-sectional partially cut away view of a preferred three-seal wire line retrievable valve of this invention installed in a side pocket gas lift mandrel segment, shown in the punctuated, venting position, with no radial mandrel porting shown.
Figure 14:
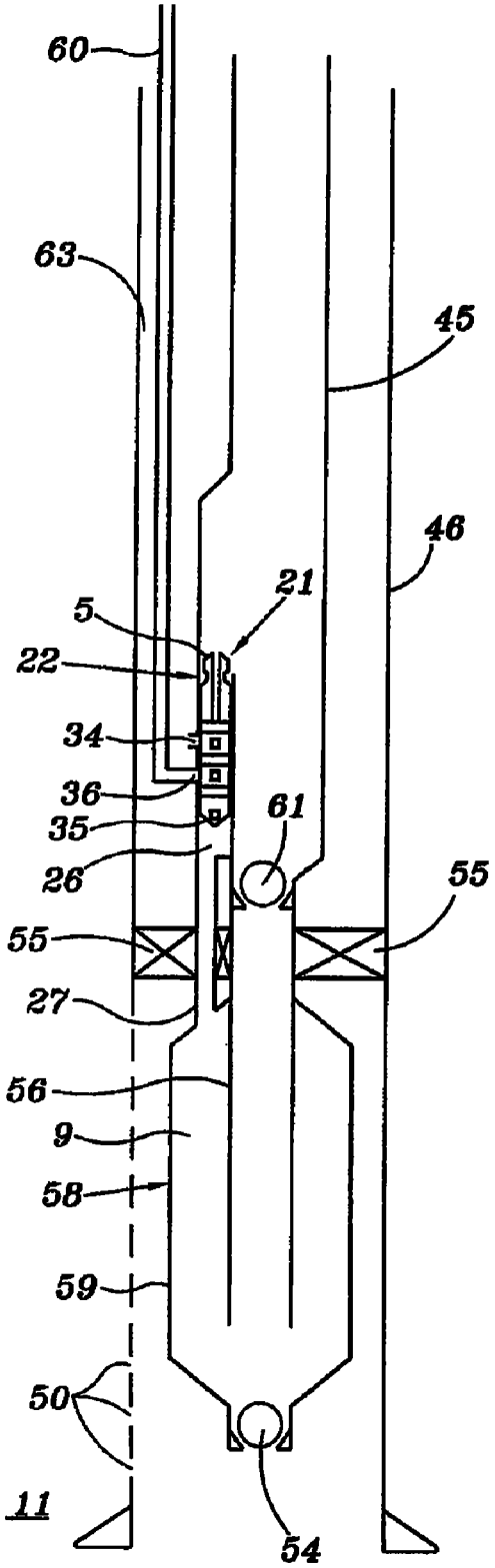
FIG. 14 is a schematic view of a well utilizing a preferred wire line retrievable three-seal purge and vent valve and mandrel of the present invention having the bottom external discharge configuration and an external side string conduit to provide venting of expended gas to the surface.

FIGS. 5 and 6 illustrate cross sectional views of a preferred valve mechanism of the present invention installed in two of the mandrel configurations of the present invention. FIG. 5 shows a side pocket mandrel 22, having an external pocket wall 31 and an internal pocket wall 41, with a two-way purge and vent valve 21. The two-way valve 21 has a bottom external discharge configuration wherein the pocket discharge end 26 is connected to a conduit 27 external to the side pocket mandrel 22. Conduit 27 connects the ported bottom cap 35 of the two-way purge and vent valve 21 with the annulus 9 between the dip tube 56 and shell 59 of chamber 58 as can be seen in FIG. 14. Although present, the passageway 16 and radial porting in the valve receiver pocket for the injection gas 20 are not shown in this illustration. FIG. 6 depicts a mandrel of a hanger configuration in which the pocket discharge end 26 is connected directly to the annular space 9 formed by the chamber shell 59 and the dip tube 30 of chamber 58.

Figure 7:
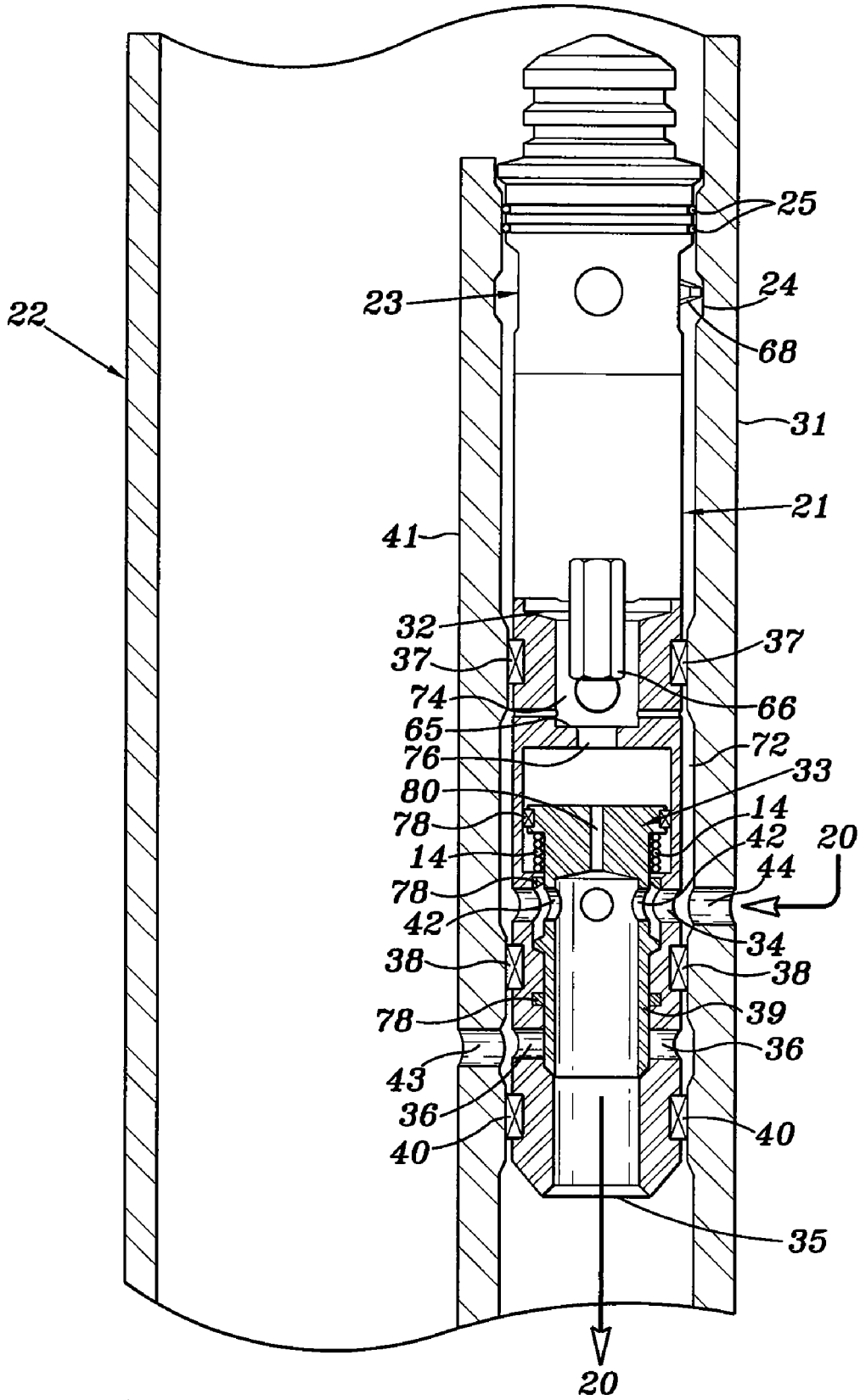
FIG. 7 is a cross-sectional partially cut away view of a preferred three-seal wire line retrievable valve of this invention installed in a side pocket gas lift mandrel segment, shown in the actuated, injection position.
Figure 8:
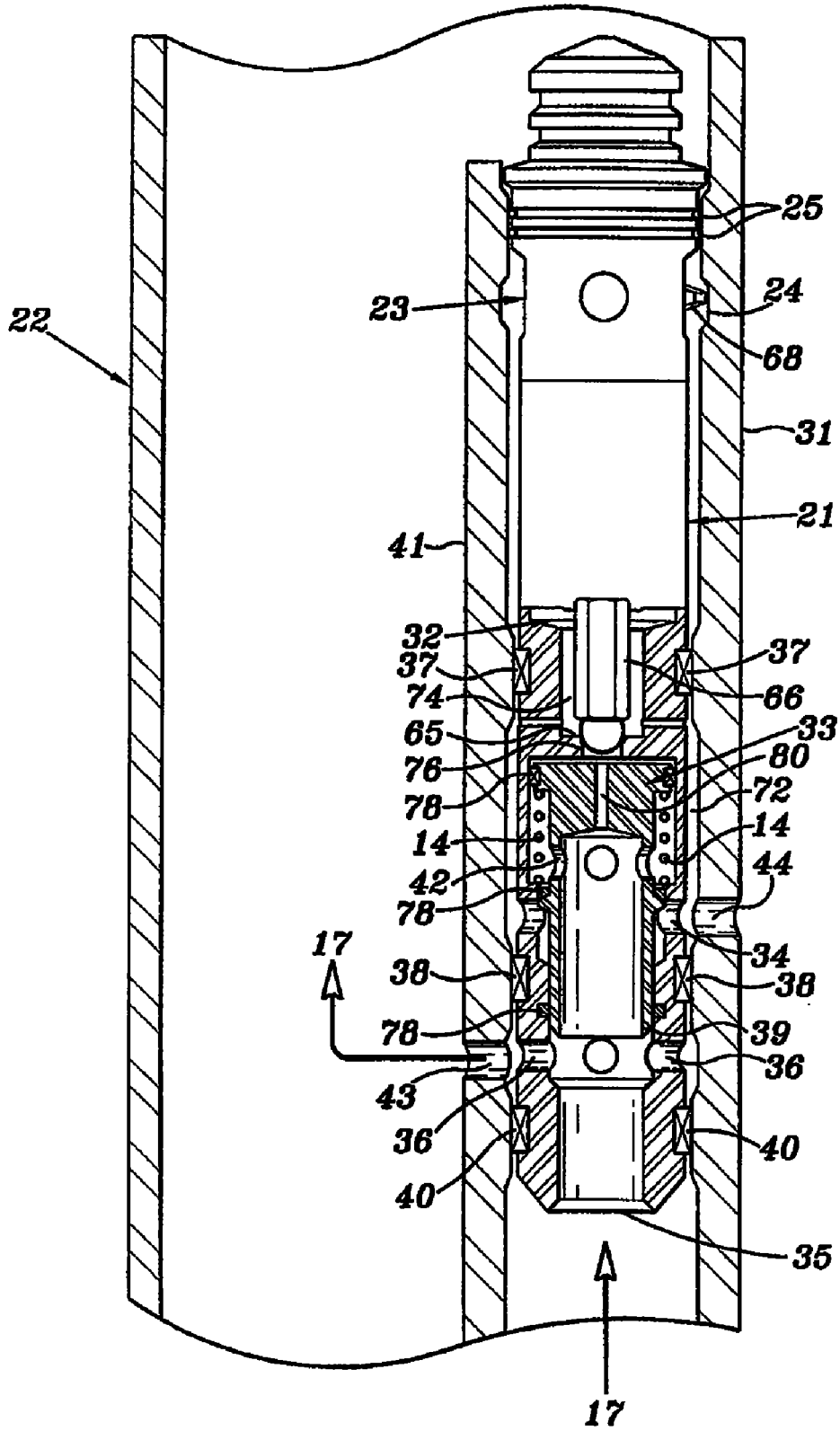
FIG. 8 is a cross-sectional partially cut away view of the embodiment of FIG. 7, shown in the un-actuated, venting position.

FIGS. 7 and 8 illustrate cross section views of one of four possible flow configurations of a preferred pocket and valve combination of the present invention. The two-way valve 21 depicted in FIGS. 7 and 8 are partially cut away to show the internal structure.

FIG. 7 shows flow from the mandrel body exterior 31 when the two-way valve is in the purge mode. Injection gas 20 enters through upper outlet port 44 in the exterior pocket wall 31 between upper seal 37 and middle seal 38. Injection gas 20 passes up through channel 72 and into pilot chamber 74. When the pressure of injection gas 20 in pilot chamber 74 is high enough, pilot stem 66 is pushed off of pilot valve seat 65. Valve pilot section 32 can be a conventional bellows valve, such as the one generally depicted in FIG. 3. The lifting of pilot stem 66 off pilot valve seat 65 opens pilot port 76 and allows injection gas 20 to actuate the main valve section 33 downward. Additional seals 78 are present to provide a seal between main valve section 33 and the interior of two-way valve 21. Movement of main valve section 33 downward causes valve mechanism 39 to block vent ports 36 in the two-way valve 21 and align valve openings 42 in valve mechanism 39 with injection passageway 34 and upper port 44 to allow injection gas 20 to enter valve mechanism 39. This places upper port 44 in fluid communication with ported bottom cap 35, allowing injection gas 20 to pass out the bottom of the two-way valve 21.

FIG. 8 shows the two-way valve 21 of FIG. 7 in the vent position. The pressure of injected gas 20 is low enough that pilot valve stern 66 is seated on pilot valve seat, closing off pilot port 76. Without injection gas 20 pushing it down, return springs 14 push the main valve section 33 back to its upper position. Bleed valve 80 allows injected gas 20 to pass through main valve section 33 when return spring 14 is moving main valve 33 back to its upper position. In this manner, injected gas 20 between main valve 33 and pilot valve section 32 does not prevent main valve 33 from fully returning to the upper position. With main valve section 33 in the upper position, valve mechanism 39 blocks injection port 34 in the valve 21 and upper port 44 in the external pocket wall 31, preventing injection gas from entering valve mechanism 39. At the same time, valve mechanism 39 unblocks vent port 36 and lower port 43 in interior pocket wall 22. This allows vent gas 17 to flow in through bottom cap 35 into valve mechanism 39 and out vent port 36 and 43, located between bottom seal 40 and middle seal 38.

Regardless of whether two-way valve 21 is in the purge or vent position, injected gas 20 continues to enter the production tubing 45 through continuous flow orifice valve 5. As can be better seen in FIG. 3, injected gas 20 passes up through two-way valve 21, around the pilot valve section 32 and out through continuous flow orifice valve 5. Injected gas 20 may also pass up in the space alongside a portion of two-way valve 21 inside of the side pocket mandrel 22 instead of passing through a channel running the entire way up through two-way valve 21.

Figure 9:
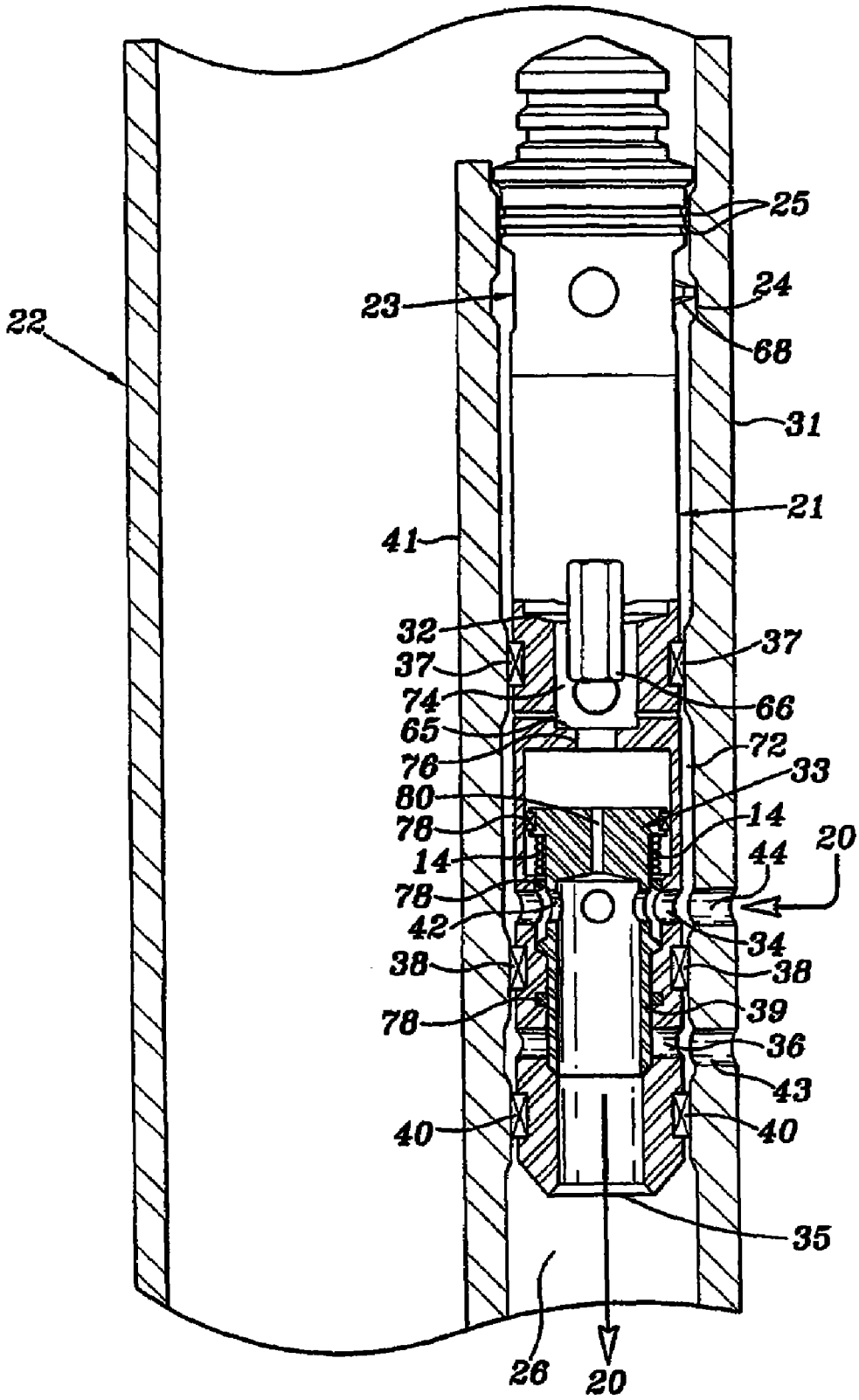
FIG. 9 is a cross-sectional partially cut away view of an embodiment of the current invention, similar to the embodiment of FIG. 7, shown with the valve in the actuated, injection position, except with an external injection passageway and an external vent port.
Figure 10:
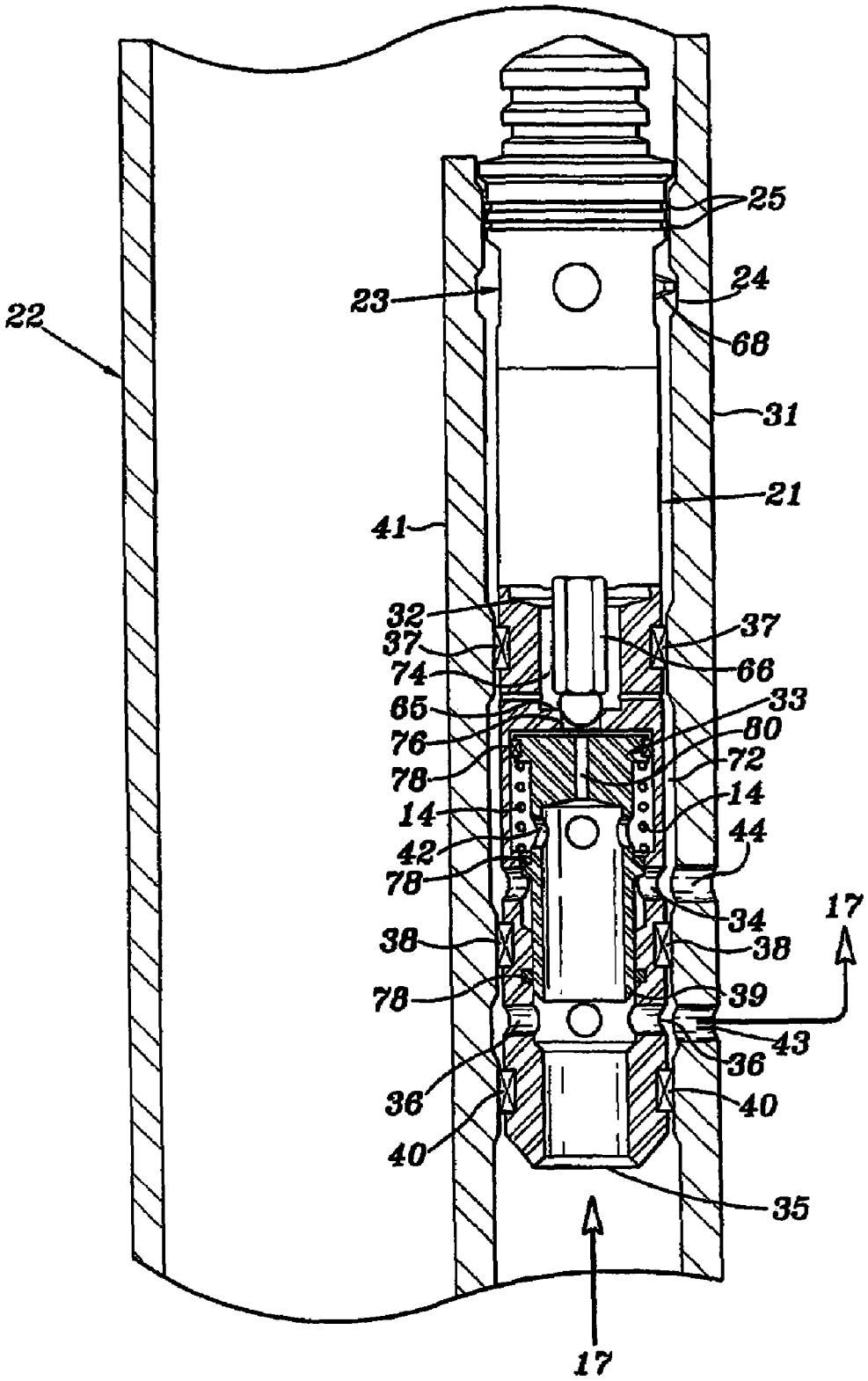
FIG. 10 is a cross-sectional partially cut away view of the embodiment of FIG. 9, shown in the un-actuated, venting position.

FIGS. 9 and 10, which are similar to FIGS. 7 and 8, are cross section, partially cut away, views of the second of four possible flow configurations of a preferred valve and pocket combination of the present invention. In this flow configuration both upper port 44 from which injected gas 20 is provided and lower port 43 through which vent gas 17 passes are located in the external pocket wall 31 in the mandrel 22. One or more separate conduits (not shown), such as the casing annulus or a separate side string conduit, would be located outside of mandrel 22 to separate injection gas 20 entering mandrel 22 through upper port 44 from the vent gas 17 exiting the mandrel through lower port 43. Like FIGS. 7 and 8, a portion of two-way valve 21 is cut away to show the interior structure of two-way valve 21.

Figure 11:
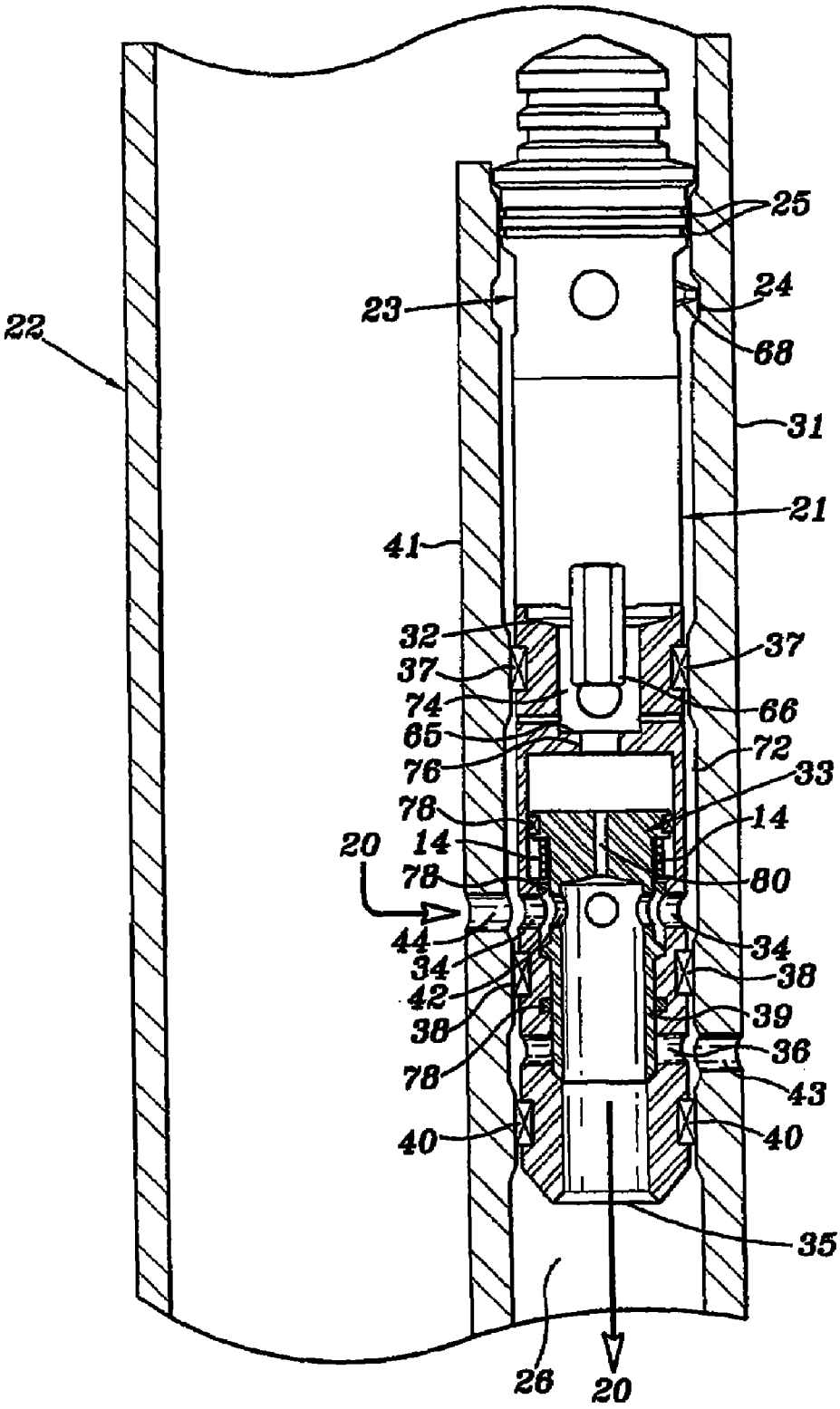
FIG. 11 is a cross-sectional partially cut away view of an embodiment that is similar to the embodiment of FIG. 7, shown with the valve in the actuated, injection position, except with an internal injection passageway and an external vent port.
Figure 12:
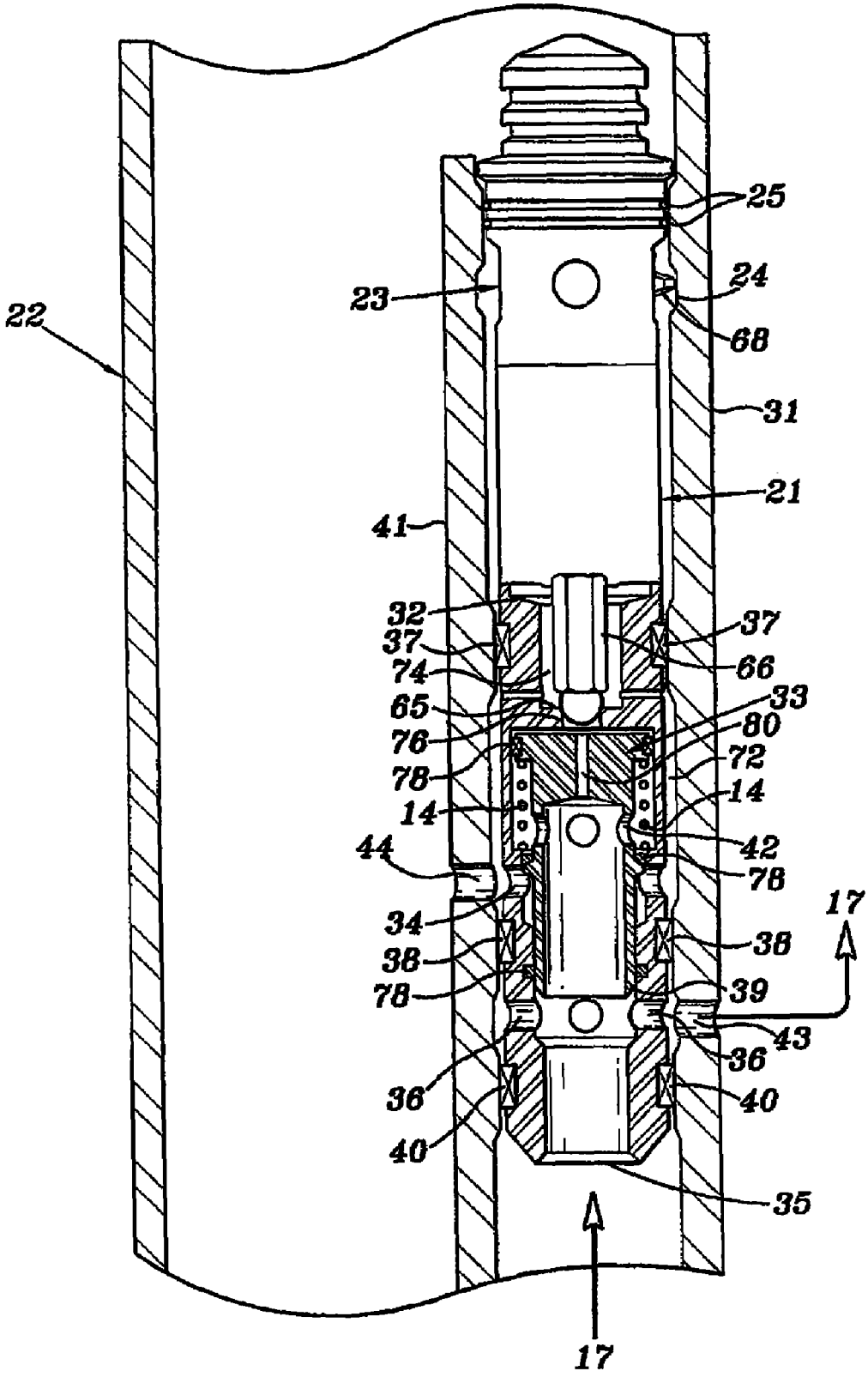
FIG. 12 is a cross-sectional partially cut away view of the embodiment of FIG. 11, shown in the punctuated, venting position.

FIGS. 11 and 12, which are similar to FIGS. 7-10, are cross section, partially cut away, views of the third of four possible flow configurations of a preferred valve and pocket combination of the present invention. In this flow configuration, the upper port 44 from which injected gas 20 is provided is located in the interior pocket wall 41 of mandrel 22. The lower port 43, through which vent gas 17 exits the two-way valve 21 is located in the external pocket wall 31 of the mandrel 22. Again one or more conduits that ate not shown may be present to provide injected gas 20 to upper port 44 and carry vent gas from lower port 43 to the surface.

The fourth of the four possible flow configurations of a preferred valve and pocket combination of the present invention, wherein both the upper port 44 for the injection gas 20 and the lower port 43 for the vent gas 17 are in the interior pocket wall 41 of the mandrel 22 is not illustrated. In this flow configuration a separate conduit would be present inside the mandrel 22 to carry the vent gas 17 to the surface.

Figure 13:
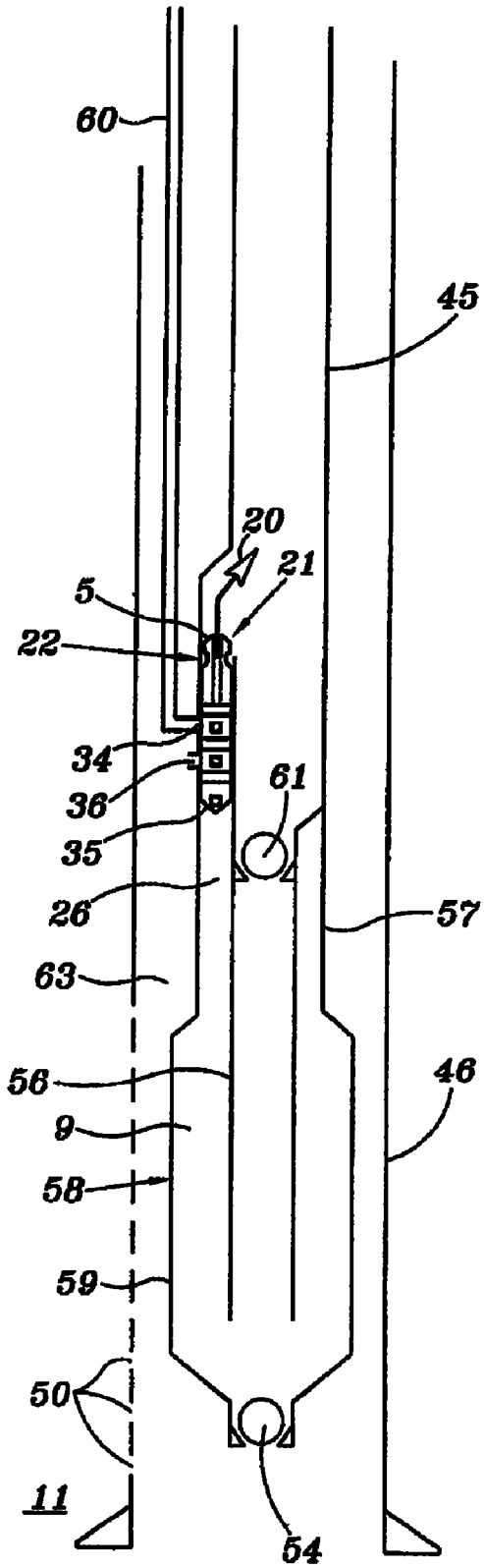
FIG. 13 is a schematic view of a well utilizing a preferred wire line retrievable three-seal purge and vent valve and mandrel of the present invention referred to as a two stage lift chamber-lift pump.
Figure 15:
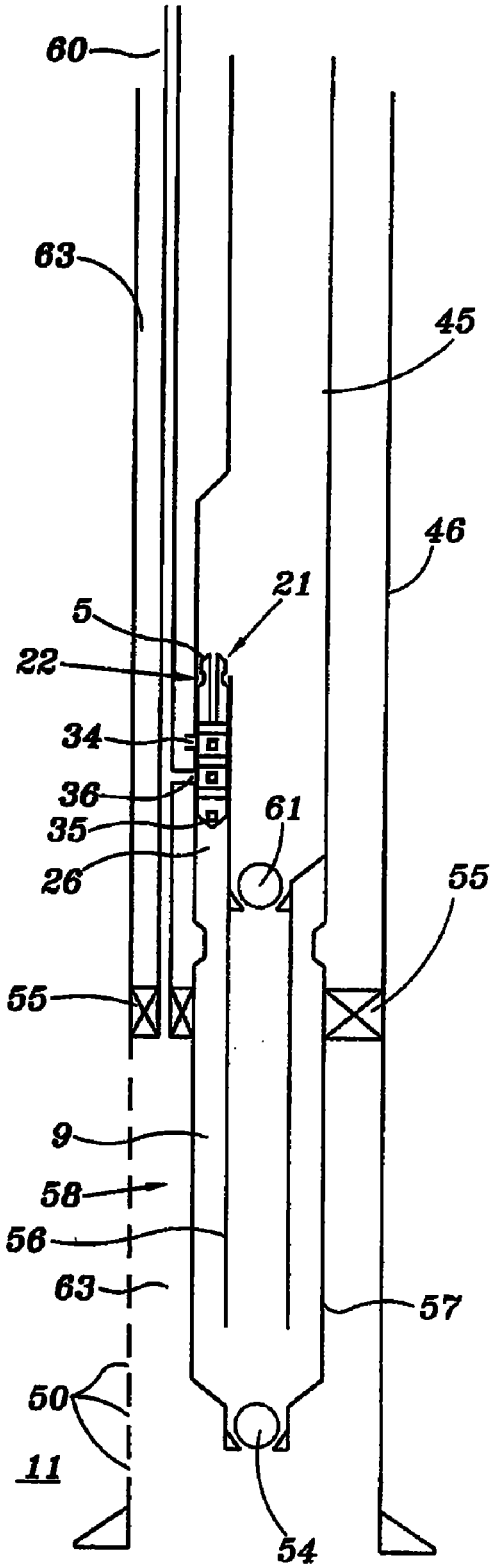
FIG. 15 is a schematic view of a well utilizing a preferred wire line retrievable three-seal purge and vent valve and mandrel of the present invention having the hanger configuration and an external side string conduit to provide venting of expended gas and formation gas trapped below the packer to the surface.

FIGS. 13-15 illustrate well schematics wherein the preferred two-way valve 21 of the present invention is used in three different two-stage chamber gas pump configurations.

The hanger mandrel version, as shown in FIG. 6, is shown in FIGS. 13 and 15 and the bottom discharge version, as shown in FIG. 5, is shown in FIG. 14; however, either the bottom discharge version or the hanger mandrel version can be used in the applications shown in FIGS. 13-15.

In FIG. 13 a side string conduit 60 connects to and supplying injection gas 20 to the preferred two-way valve 21 of the present invention. Chamber 58, with a chamber shell 59, a dip tube 56, and a lower check valve 54, forms the first stage of the two-stage pump. An upper check valve 61 and a continuous flow orifice valve 5 form the second stage of the pump. The casing-tubing annulus 63 is used for the venting produced gas 13 that does not enter the chamber and the vent gas 17 that is vented between injection cycles.

In FIG. 14, a well schematic of a two-stage chamber pump embodiment of the current invention using the preferred two-way purge and vent valve 21 is shown with the use of a packer 55. Side string conduit 60 is connected to the vent port 36 of the two-way valve 21 to vent the vent gas 17 to the surface. The casing-tubing annulus 63 above the packer 55 is used for injection gas to purge the insert chamber and also for the continuous flow orifice valve 5.

FIG. 15, is a cross section view of a two-stage chamber pump with packer 55. Side string conduit 60 connects to the venting port 36 of the preferred two-way valve 21 and goes through the packer 55. Side string conduit 60 is used to vent both vent gas 17 from chamber 58 and formation produced gas 13 from formation 11 that may be trapped below the packer. The casing-tubing annulus 63 above the packer 55 is used for injection gas 20 to purge the chamber 58 and also for the continuous flow orifice valve 5.

From the foregoing it will be seen that the preferred embodiments of the invention are well adapted to attain all of the ends and objects hereinabove set forth together with other advantages which are inherent to the apparatus. It will be understood that certain features and subcombinations are of utility and may be employed with reference to other features and sub-combinations. This is contemplated by and is within the scope of the claims.

The above descriptions of certain embodiments are made for the purposes of illustration only and are not intended to be limiting in any manner. Other alterations and modifications of the preferred embodiment will become apparent to those of ordinary skill in the art upon reading this disclosure, and it is intended that the scope of the invention disclosed herein be limited only by the broadest interpretation of the appended claims to which the inventor is legally entitled.

What is claimed is:

1. A combination two-way control valve and continuous injection valve for use in a system for continuously producing liquids from an oil or gas well comprising:

an upper seal, a middle seal, and a lower seal on the exterior of the two-way valve, wherein the seals are adapted to seal the two-way valve in a pocket in a side pocket mandrel;

a radial gas port located between the upper and middle seal;

a radial vent port located between the middle and lower seal;

a chamber port located below the lower seal;

a pilot valve section, a main valve section, and a channel from the gas port to the pilot valve section, a latch device secured to the two-way valve, wherein the latch device is adapted to secure the two-way valve in a side pocket mandrel;

wherein the gas port is adapted to provide injected gas having a pressure to the two-way valve;

wherein the pilot valve section when actuated by an increased pressure of the injected gas opens a port to allow injected gas to actuate the main valve section to open a pathway from the gas port to the chamber port;

wherein the main valve section when not actuated provides a pathway from the chamber port to the vent port; and wherein the two-way valve is configured for wire line retrieval and installation.

2. The two-way control valve of claim 1 wherein the pilot valve section comprises of a bellows, a stem connected to the bellows, a return mechanism, and a valve seat disposed proximate to the stem, wherein changes in pressure applied to the bellows translates the stem to selectively seat in the valve seat.

3. The two-way control valve of claim 2 wherein the return mechanism is a spring.

4. The two-way control valve of claim 2 wherein the return mechanism is an internal gas charge in the bellows.

5. The two-way control valve of claim 2 wherein the main valve section further comprises:

a cylindrical sleeve closed at the top end and open at the bottom end disposed within a cylindrical chamber within the two-way valve;

an unobstructed internal flow bore;

a gas injection radial port;

an external seal adapted to seal the main valve section in the chamber in the two-way valve;

an external conical sealing surface at the lower end to allow sealing of the sleeve to a bottom of the chamber in the two-way valve when the main valve section is in its lower position;

an internal bleed port in its upper end to allow gas trapped between the main valve section and the closed pilot valve section to escape so the main valve section can fully return to its upper position;

a closing spring adapted to move the main valve body to an upper position when the pilot valve section is closed;

wherein injected gas actuates the main valve assembly by translating the main valve assembly from an upper position to a lower position;

wherein in the lower position, the radial injection ports in the sleeve align with the radial gas port, thereby providing an unobstructed path through the internal bore of the main valve section from the radial gas port to the chamber port and the sleeve blocks the radial vent port; and wherein when the main valve section is in the upper position, the sleeve blocks the radial gas port and unblocks the radial vent port, thereby providing an unobstructed path from the chamber port to the radial vent port.

6. The two-way valve of claim 1 wherein the two-way valve is disposed in a valve receiver pocket of a mandrel comprising:

an upper and a lower hollow, generally cylindrical ends;

a hollow and generally cylindrical body;

an internal through bore within the and generally parallel to the mandrel body;

a valve receiver pocket at least partially internal to and generally parallel to the body of the mandrel, having two ends and upper, middle and lower seal bore areas;

a gas injection port between the upper and middle seal bores in the valve receiver pocket adapted to provide injection gas from the surface; and a venting port between the middle and lower seal bores in the valve receiver pocket adapted to vent the vent gas to the surface.

7. The two way valve and mandrel of claim 6 wherein the mandrel has a hanger configuration below the valve receiver pocket.

* * * * *

UNITED STATES PATENT AND TRADEMARK OFFICE

CERTIFICATE OF CORRECTION

PATENT NO. : 7,658,229 B2
APPLICATION NO. : 11/278249
DATED : February 9, 2010
INVENTOR(S) : Becker et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 438 days.

Signed and Sealed this

Thirtieth Day of November, 2010

David J. Kappos

David J. Kappos
*Director of the United States Patent and Trademark Office*